US010358868B2

(12) United States Patent
Hall et al.

(10) Patent No.: US 10,358,868 B2
(45) Date of Patent: Jul. 23, 2019

(54) EMBEDDED INTERCONNECTING DRIVE SYSTEM

(71) Applicants: David R. Hall, Provo, UT (US); Joe Fox, Spanish Fork, UT (US); Kelly Knight, Orem, UT (US); Hyrum Malone, Provo, UT (US)

(72) Inventors: David R. Hall, Provo, UT (US); Joe Fox, Spanish Fork, UT (US); Kelly Knight, Orem, UT (US); Hyrum Malone, Provo, UT (US)

(73) Assignee: Hall Labs LLC, Provo, UT (US)

( * ) Notice: Subject to any disclaimer, the term of this patent is extended or adjusted under 35 U.S.C. 154(b) by 188 days.

(21) Appl. No.: 15/285,004

(22) Filed: Oct. 4, 2016

(65) Prior Publication Data

US 2018/0094483 A1 Apr. 5, 2018

(51) Int. Cl.

| | |
|---|---|
| ***E06B 9/40*** | (2006.01) |
| ***E06B 9/42*** | (2006.01) |
| ***E06B 9/58*** | (2006.01) |
| ***E06B 9/171*** | (2006.01) |
| ***E06B 9/173*** | (2006.01) |
| ***E06B 9/11*** | (2006.01) |
| ***E06B 9/44*** | (2006.01) |
| ***E06B 9/48*** | (2006.01) |

(52) U.S. Cl.

CPC ..... *E06B 9/42* (2013.01); *E06B 9/11* (2013.01); *E06B 9/171* (2013.01); *E06B 9/173* (2013.01); *E06B 9/40* (2013.01); *E06B 9/44* (2013.01); *E06B 9/48* (2013.01); *E06B 9/58* (2013.01)

(58) Field of Classification Search

CPC ... E06B 9/42; E06B 9/40; E06B 9/173; E06B 9/44; E06B 9/58; E06B 9/11; E06B 9/171; E06B 9/48

USPC ..... 160/238, 264–266, 290.1, DIG. 10, 160/DIG. 15

See application file for complete search history.

(56) References Cited

U.S. PATENT DOCUMENTS 3,092,175 A * 6/1963 Suessle ..... A47C 31/04 135/119
4,175,608 A * 11/1979 Alten ..... E06B 9/13 160/273.1

(Continued)

FOREIGN PATENT DOCUMENTS

DE 3936410 A1 * 5/1991 ..... A47K 3/38
FR 2644841 A2 * 9/1990 ..... E06B 9/08
GB 190926261 A * 10/1910 ..... E06B 9/48

*Primary Examiner* — Robert Canfield

(57) ABSTRACT

The present invention is directed to an embedded interconnecting drive system. The drive system is used to deploy and retract flexible, roll-up panels away from or onto a roller drum as the drum rotates on its longitudinal axis. In this invention, a plurality of cogs, each comprising a semi-tubular recess and tapered shaft, interact with each other to induce the flexible panel to move in concert with the roller drum as the roller drum rotates, preventing the flexible panel from unraveling on the drum. The cogs compel the flexible panel to deploy away and downward from the drum as it rotates deployingly, and to retract onto the roller drum as it rotates retractingly. This invention discloses details of the cog and a complimentary annular lock disc used to secure the cog to a flexible panel. Further, this invention discloses a plurality of embodiments of the embedded interconnecting drive system.

19 Claims, 6 Drawing Sheets

(56) References Cited

U.S. PATENT DOCUMENTS 7,748,431 B2 * 7/2010 Jansen ..... E06B 9/13
160/264
9,194,178 B2 * 11/2015 Andre de la Porte .. E06B 9/581

* cited by examiner

EMBEDDED INTERCONNECTING DRIVE SYSTEM

BACKGROUND

Field of the Invention

This invention generally relates to flexible, roll-up panel systems. More particularly, this invention relates to an embedded interconnecting drive system used to retract and deploy a flexible, roll-up panel as the roller drum around which the flexible panel is wound rotates on its longitudinal axis.

Background of the Invention

Flexible, roll-up panels have been used as window coverings, projector screens, awnings, and door coverings. In each application, the need exists to deploy the flexible panel away and downward from the roller on which is disposed. Prior art asserts the need for devices which apply a pulling tension on the flexible panel using devices such as wood and metal strips or metal weights disposed inside the flexible panel fabric at the lower or leading edge, and downward pulling cord systems to assist in deploying said panels downward, and to prevent the panel from unraveling on the roller drum as the drum rotates. Prior art from the film industry suggests that one method of feeding material away from a roller drum, reel, or spindle is to move the material by use of teeth on sprockets which engage complimentary holes in the material. These prior art devices do not fit every application for deploying a flexible, roll-up panel, and as such the need currently exists for a drive system that is embedded in the flexible panel which asserts a pushing force on the flexible panel as the roller drum deploys the panel, and a pulling force on the flexible panel as the roller drum retracts the flexible panel.

SUMMARY

This invention has been developed in response to the present state of the art and, in particular, in response to the problems and needs in the art that have not yet been fully solved by current deployment and retraction systems for flexible, roll-up panels. Accordingly, an interconnecting drive system has been developed that is embedded in the fabric or material of flexible, roll-up panels. Features and advantages of different embodiments of the invention will become more fully apparent from the following description and appended claims, or may be learned by practice of the invention as set forth hereinafter.

Consistent with the foregoing, an embedded interconnecting drive system is disclosed. A roller drum is disclosed. A flexible panel attached to the roller drum is disclosed. A winding mechanism is disclosed. A plurality of cogs is disclosed. A plurality of annular lock discs is disclosed.

Embedded interconnecting drive system is defined as a mechanism by which a flexible panel is induced to deploy from or retract onto a roller drum as the roller drum rotates on its longitudinal axis in a deploying or retracting direction. In this invention, the drive system comprises a plurality of cogs embedded within a flexible panel such that the cogs interact with each other to move the flexible panel off the roller drum as the drum rotates deployingly, or gather the flexible panel onto the roller drum as it rotates retractingly.

A cog is defined as an element having a head, a semi-tubular recess, a tapered shaft, and a sheath.

An annular lock disc is defined as a ring-type disc which is disposed around the sheath of a cog, and when the sheath of the cog is pressed over the annular lock disc secures the cog to a flexible panel.

DETAILED DESCRIPTION OF CERTAIN EMBODIMENTS

It will be readily understood that the components of the present invention, as generally described and illustrated in the Figures herein, may be designed in a wide variety of different configurations. Thus, the following more detailed description of one embodiment of the invention is not intended to limit the scope of the invention, as claimed, but is merely representative of certain examples of presently contemplated embodiments in accordance with the invention. The presently described embodiments will be best understood by reference to the claims and drawings.

Although any number of embodiments may be considered, the following suggests one example: a flexible, mass-loaded vinyl panel having a first side, a second side, an upper side, and a lower side, is joined along the upper side to a roller drum. A plurality of cogs are embedded intermittently and latitudinally along the first and second sides of the flexible, mass-loaded vinyl panel, the cogs held in place by a plurality of complimentary annular lock discs. The semi-tubular recesses of the plurality of cogs interconnect with the tapered shafts of the plurality of cogs when the flexible panel is wound around the roller drum. As the roller drum is rotated on its longitudinal axis to deploy the flexible, mass-loaded vinyl panel, the plurality of cogs imposes a deploying force on the panel as the panel is unwound. As the roller drum is rotated on its longitudinal axis to retract the flexible, mass-loaded vinyl panel, the plurality of cogs imposes a retracting force on the panel as the flexible panel is wound around the roller drum. Features and advantages of additional embodiments of the invention may become more fully apparent or may be learned by practice of the invention as set forth hereinafter.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION OF THE DRAWINGS

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
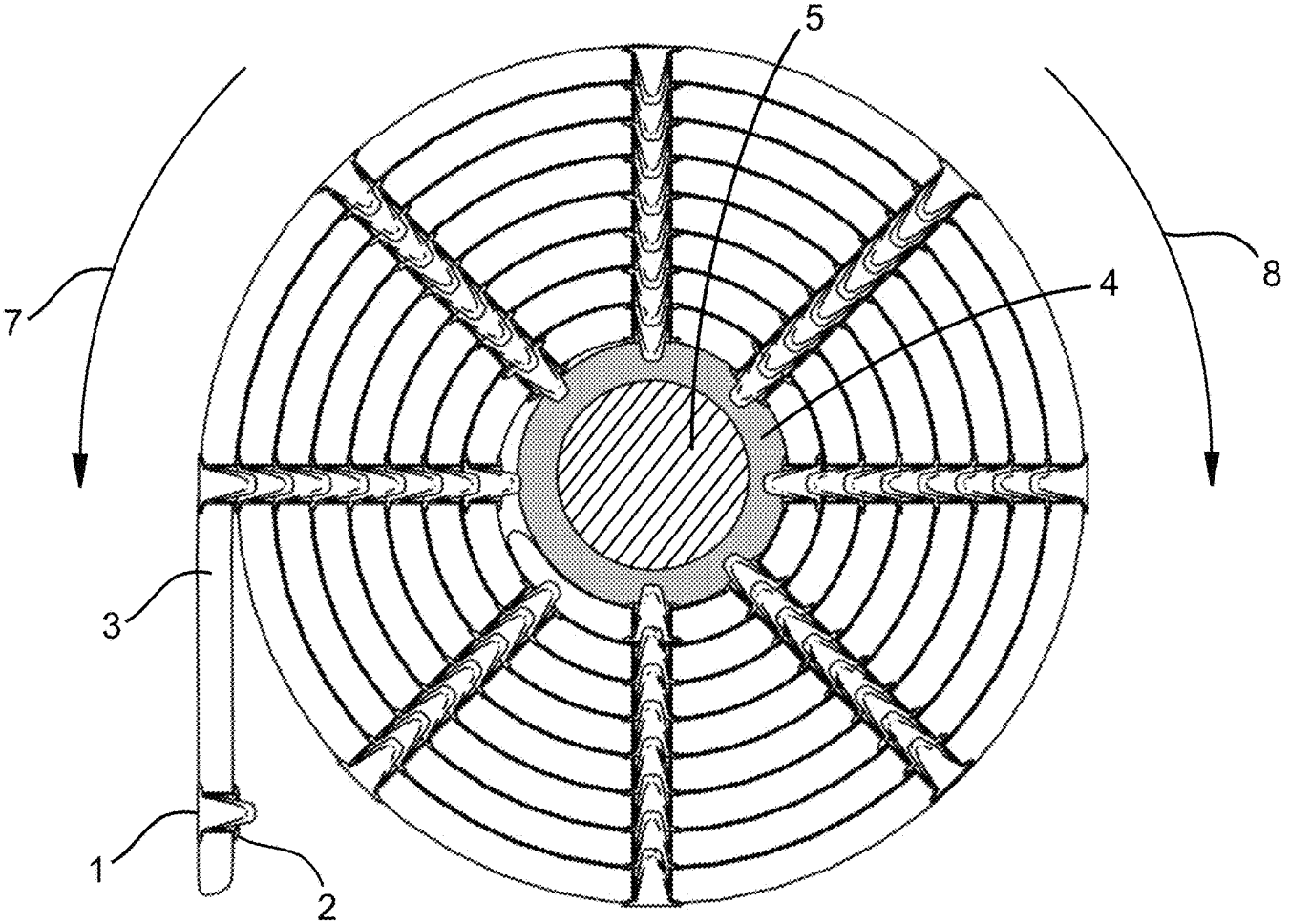
FIG. 1 is a cut-away view illustrating a cog, an annular lock disc, a flexible panel, a roller drum, and a winding mechanism.

FIG. 1 is a cut-away view illustrating a plurality of cogs 1, a plurality of annular lock discs 2, a flexible panel 3, a roller drum 4, a winding mechanism 5. In this Figure, the flexible panel 3 is wound around the roller drum 4, the plurality of cogs 1 interconnecting with the plurality of cogs 1. As the winding mechanism 5 is engaged in a deploying direction 7, the roller drum 4 rotates on its longitudinal axis to deploy the flexible panel 3. To prevent the flexible panel 3 from unraveling on the roller drum 4, the interconnected cogs 1 impose a deploying force against each other to move the flexible panel 3 around and off the roller drum 4. The interconnected cogs 1 separate as the flexible panel 3 deploys off the roll. As the winding mechanism 5 is engaged in a retracting direction 8, the roller drum 4 rotates on its longitudinal axis to retract the flexible panel 3, and the plurality of cogs 1 interconnect to impose a retracting force against each other to pull the flexible panel 3 around the roller drum 4. In one embodiment, the cogs 1 comprise stainless steel. In other embodiments, the cogs 1 comprise steel, aluminum, titanium, Monel, brass, plastic, nylon, carbon fiber, polyoxymethylene, and polyvinyl chloride. In one embodiment, the annular lock discs 2 comprise stainless steel. In other embodiments, the annular lock discs 2 comprise steel, aluminum, titanium, Monel, brass, plastic, nylon, carbon fiber, polyoxymethylene, and polyvinyl chloride. In one embodiment, the flexible panel 3 comprises mass-loaded vinyl. In other embodiments, the flexible panel 3 comprises window screen, vinyl, plastic, cloth, leather, video screen, organic light-emitting diode panels, and solar panels. In one embodiment the roller drum 4 comprises a hollow core cylinder. In other embodiments the roller drum 4 comprises a solid core cylinder. In one embodiment, the roller drum 4 comprises aluminum. In other embodiments, the roller drum 4 comprises polyvinyl chloride, carbon fiber, wood, engineered wood, nylon, rubber, plastic, steel, stainless steel, brass, and titanium. In one embodiment the winding mechanism 5 is disposed inside and attached to the hollow core roller drum 4 and turns the roller drum 4 on its longitudinal axis to raise or lower the flexible panel 3. In other embodiments, the winding mechanism 5 is disposed and attached external to the roller drum 4. In one embodiment, the winding mechanism 5 comprises an electric motor. In other embodiments, the winding mechanism 5 comprises other forms of motor-driven and manual apparatuses.

Figure 2A:
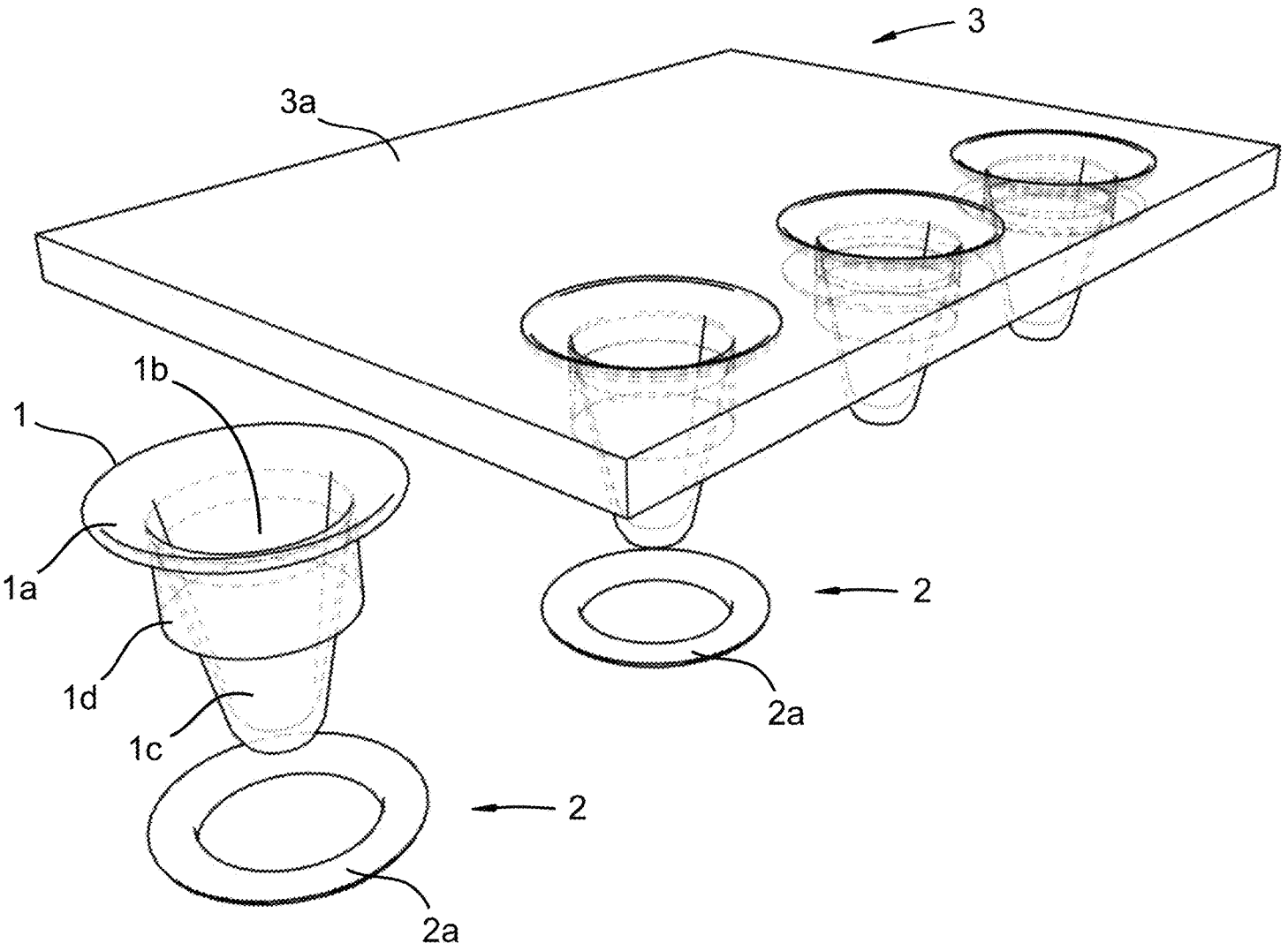
FIGS. 2A and 2B provide a top-side isometric view and a bottom-side isometric view, respectively, depicting a cog comprising a head, semi-tubular recess, tapered shaft, and sheath; an annular lock disc; and a section of a flexible panel.
Figure 2B:
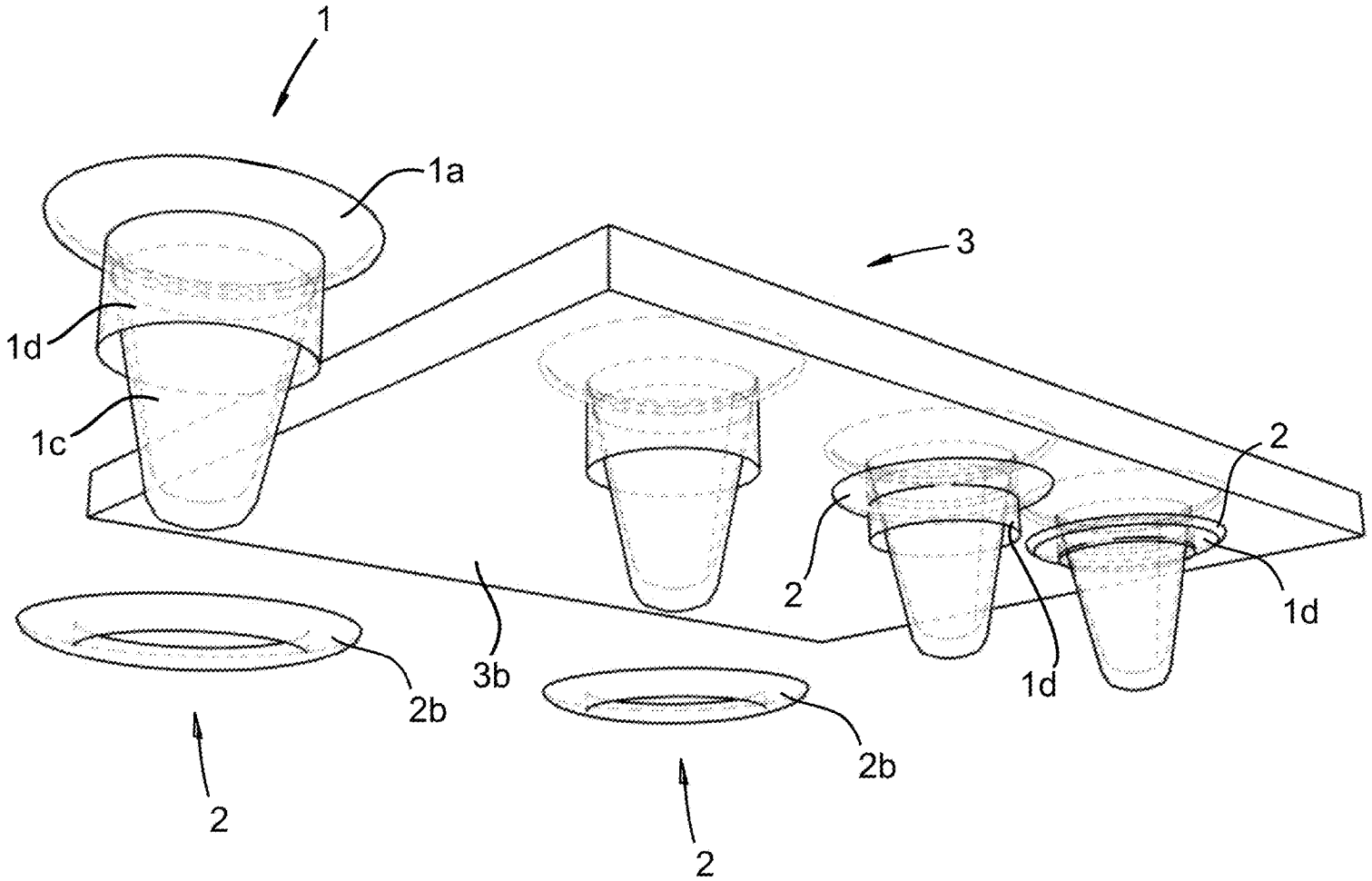

FIGS. 2A and 2B provide a top-side isometric view and a bottom-side isometric view, respectively, depicting various stages of attachment of a cog 1 to a flexible panel 3. The cog 1 comprises a head 1*a*, a semi-tubular recess 1*b*, a tapered shaft 1*c*, and a sheath 1*d*. The flexible panel comprises a first surface 3*a* and a second surface 3*b*. Also shown is an annular lock disc 2 in various stages of attachment to the cog 1, with the cog 1 disposed through the flexible panel 3. In one embodiment, the head 1*a* is concave, the head 1*a* continuing inward to form a semi-tubular recess 1*b* interior to the tapered shaft 1*c*. Extending perpendicularly away from the head 1*a* is a hollow cylinder sheath 1*d* which is disposed around the tapered shaft 1*c*. In other embodiments the head 1*a* may comprise a flat surface. In one embodiment, the cog 1 is circular. In other embodiments, the cog 1 may comprise other geometric shapes. The annular lock disc 2 comprises a concave surface 2*a* and a convex surface 2*b*. The cog 1 is disposed through the flexible panel 3, with the head 1*a* disposed on the first surface 3*a* of the flexible panel 3, and the annular lock disc 2 is disposed around the sheath 1*d*, with the concave surface 2*b* of the annular lock disc 2 adjacent the second surface 3*b* of the flexible panel 3. The sheath 1*d* is then pressed by mechanical means to flatten outward and over the convex surface 2*b* of the annular lock disc 2 to secure the cog 1 in place within the flexible panel 3.

Figure 3:
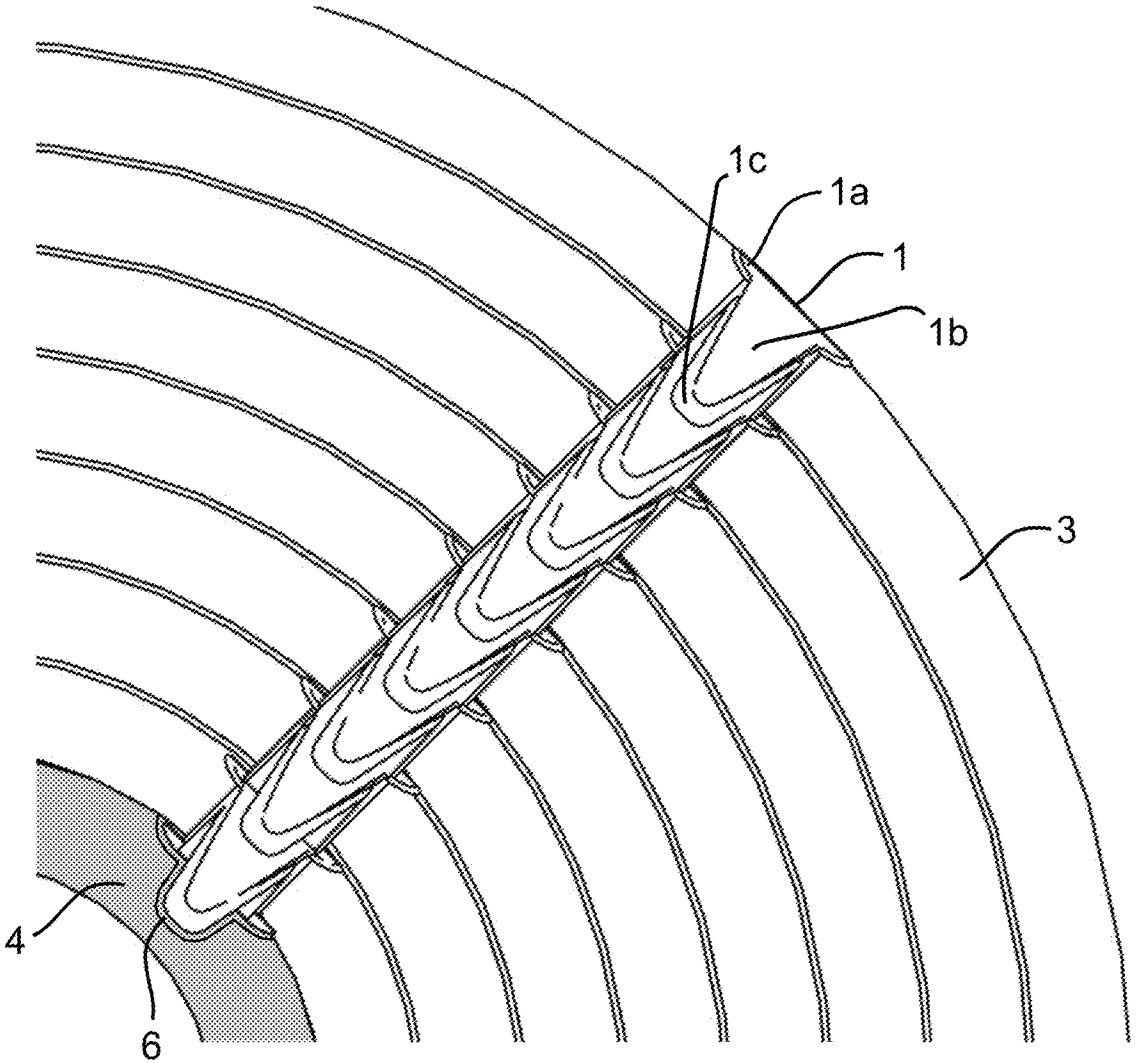
FIG. 3 is a cut-away view presenting a plurality of cogs embedded in a flexible panel wound around a roller drum, the semi-tubular recesses of the plurality of cogs interconnecting the tapered shafts of the plurality of cogs when the flexible panel is wound around the roller drum, and the tapered shaft of one cog interconnecting with a countersunk recess in the roller drum.

FIG. 3 is a cut-away view presenting a flexible panel 3 wound around itself and around a roller drum 4. A plurality of cogs 1 are embedded in the flexible panel 3, the heads 1*a* and semi-tubular recesses 1*b* of the plurality of cogs 1 interconnecting the tapered shafts 1*c* of the plurality of cogs 1 when the flexible panel 3 is wound around the roller drum 4. Also shown is the tapered shaft 1*c* of one cog 1 interconnecting with a countersunk recess 6 in the roller drum 4.

Figure 4:
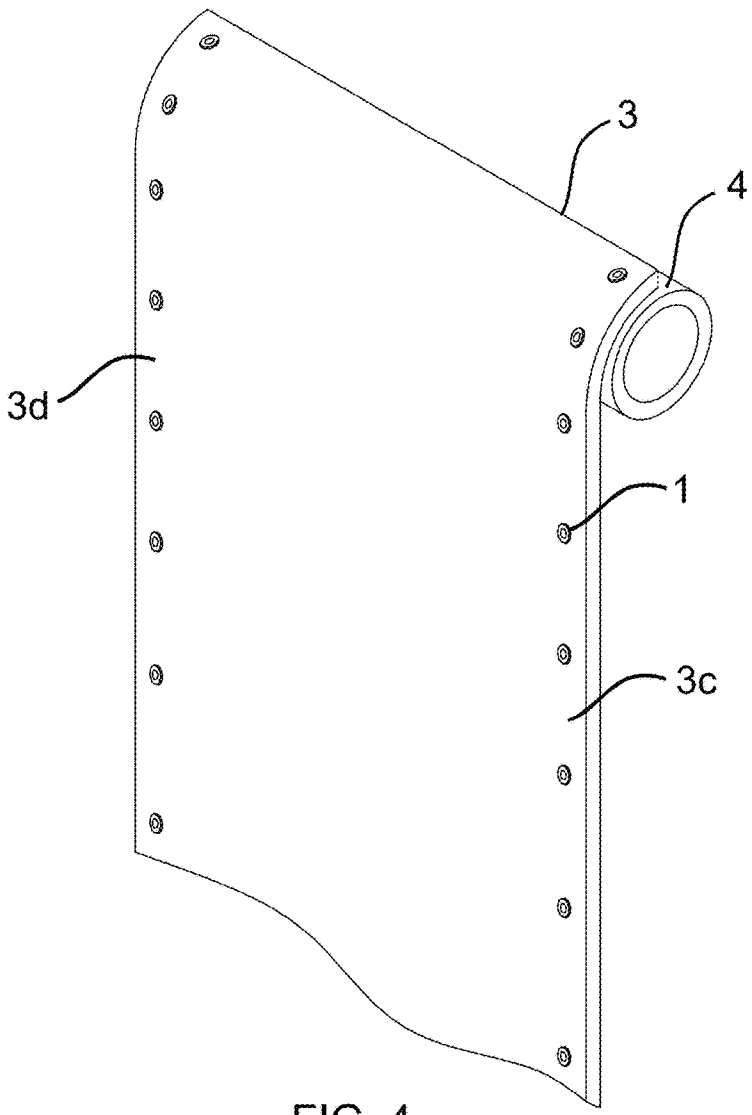
FIG. 4 provides an isometric view of a plurality of cogs disposed latitudinally along a first and second side of a flexible panel, and a roller drum.

FIG. 4 provides an isometric view of a plurality of cogs 1, a flexible panel 3, and a roller drum 4. The plurality of cogs 1 are disposed intermittently and latitudinally along a first side 3*c* and second side 3*d* of the flexible panel 3.

Figure 5:
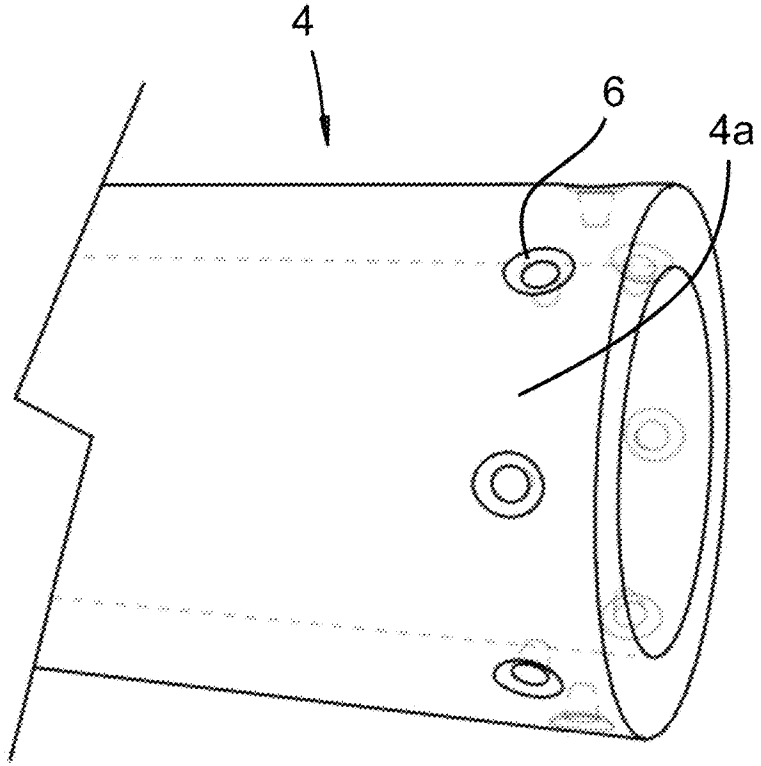
FIG. 5 provides an isometric split view of a roller drum with countersunk recesses intermittently disposed around the circumference of a first and a second end of the roller drum.
Figure 5:
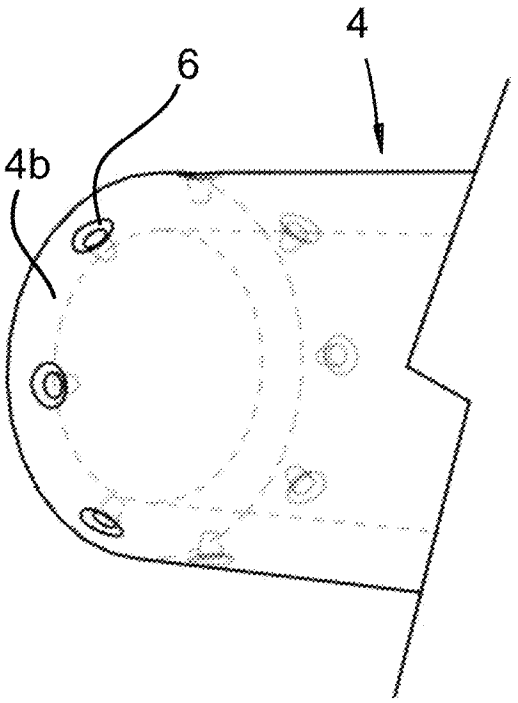

FIG. 5 provides an isometric split view depicting a roller drum 4 with a first end 4*a* and a second end 4*b*. Intermittently disposed around the circumference of the first end 4*a* and second end 4*b* are a plurality of countersunk recesses 6.

The invention claimed is:

1. An embedded interconnecting drive system to deploy and retract a flexible, roll-up panel comprising:

a roller drum;

a flexible panel joined to the roller drum;

the flexible panel having a first side, a second side, a first surface, and a second surface;

a winding mechanism attached to the roller drum;

a plurality of cogs;

a plurality of annular lock discs; the cogs and annular lock discs disposed intermittently latitudinally along the first side and the second side of the flexible panel;

the cogs disposed through the flexible panel and the annular lock discs disposed complimentarily around the cogs adjacent the second surface; wherein, the plurality of cogs interconnecting when the flexible panel is wound around the roller drum; and wherein the plurality of cogs imposing a deploying force on the panel as the panel is unwound and a retracting force on the panel as the panel is wound around the drum.

2. The embedded interconnecting drive system of claim 1 wherein the roller drum comprises material which is selected from the group consisting of hollow core cylinders and solid core cylinders.

3. The embedded interconnecting drive system of claim 1 wherein the roller drum further comprises countersunk recesses disposed around opposite ends of the roller drum.

4. The embedded interconnecting drive system of claim 3 wherein the plurality of cogs disposed on the first and second sides of the flexible panel interconnect with the countersunk recesses disposed on the opposite ends of the roller drum.

5. The embedded interconnecting drive system of claim 1 wherein the roller drum further comprises material which is selected from the group consisting of polyvinyl chloride, carbon fiber, wood, engineered wood, nylon, rubber, and plastic.

6. The embedded interconnecting drive system of claim 1 wherein the roller drum further comprises metal which is selected from the group consisting of steel, stainless steel, aluminum, brass, and titanium.

7. The embedded interconnecting drive system of claim 1 where in the flexible panel is joined to the roller drum by means of chemical and mechanical attachments.

8. The embedded interconnecting drive system of claim 1 wherein the flexible panel comprises materials selected from the group consisting of window screen, sun screen, vinyl, plastic, mass-loaded vinyl, cloth, leather, video screen, organic light-emitting diode panels, and solar panels.

9. The embedded interconnecting drive system of claim 1 wherein the winding mechanism turns the roller drum on its longitudinal axis to raise and lower the flexible panel.

10. The embedded interconnecting drive system of claim 1 wherein the winding mechanism comprises devices which are selected from the group consisting of manual and motor-driven apparatuses.

11. The embedded interconnecting drive system of claim 1 wherein each of the cogs comprises a head, a semi-tubular recess, and a tapered shaft.

12. The embedded interconnecting drive system of claim 11 wherein the head comprises a concave first surface and a convex second surface, the concave first surface continuing to the semi-tubular recess, and the semi-tubular recess extending into the tapered shaft.

13. The embedded interconnecting drive system of claim 12 wherein each of the cogs further comprises a sheath extending from the convex surface of the head and comprising a hollow cylinder disposed around the tapered shaft.

14. The embedded interconnecting drive system of claim 1 wherein the plurality of cogs comprise metals selected from the group consisting of stainless steel, steel, aluminum, titanium, Monel, and brass.

15. The embedded interconnecting drive system of claim 1 wherein the plurality of cogs comprise material selected from the group consisting of plastic, nylon, carbon fiber, polyoxymethylene, and polyvinyl chloride.

16. The embedded interconnecting drive system of claim 1 wherein the annular lock discs comprise a concave first surface and a convex second surface.

17. The embedded interconnecting drive system of claim 1 wherein the plurality of annular lock discs disposed around the plurality of cogs are secured in place by means of the sheaths flattened over the convex surfaces of the plurality of annular lock discs.

18. The embedded interconnecting drive system of claim 1 wherein the plurality of annular lock discs comprise metals selected from the group consisting of stainless steel, steel, aluminum, titanium, Monel, and brass.

19. The embedded interconnecting drive system of claim 1 wherein the plurality of annular lock discs comprise material selected from the group consisting of plastic, nylon, carbon fiber, polyoxymethylene, and polyvinyl chloride.

* * * * *